United States Patent [19]

Skowronski et al.

[11] Patent Number: 4,809,979

[45] Date of Patent: Mar. 7, 1989

[54] ELECTRONIC PUZZLE DEVICE

[75] Inventors: Steven D. Skowronski, South Milwaukee; Glen E. McClune, Cedarburg, both of Wis.

[73] Assignee: Ultimate Creations, Inc., South Milwaukee, Wis.

[21] Appl. No.: 96,560

[22] Filed: Sep. 14, 1987

[51] Int. Cl.[4] ..... A63F 9/06

[52] U.S. Cl. ..... 273/153 R; 273/1 E

[58] Field of Search ..... 273/153 R, 153 S, 146

[56] References Cited

U.S. PATENT DOCUMENTS 4,575,087 3/1986 Sinclair ..... 273/153 R

*Primary Examiner*—Leo P. Picard
*Assistant Examiner*—Jessica J. Harrison
*Attorney, Agent, or Firm*—Andrus, Sceales, Starke & Sawall

[57] ABSTRACT

A puzzle has a cube housing and is solved by rotating the faces into a horizontal plane. Each face has multicolor lamps which are one color when the puzzle is solved. Each lamp may be red, green or yellow by producing red and green together. A microprocessor programmed to read switches in the cube to define the cube orientation and particularly the horizontal face. The processor has a table of algorithms which are assigned to edges between adjacent faces. Upon rotation of the cube about an edge in the horizontal plane, the microprocessor executes the assigned algorithm upon the previously existing display of that face. The microprocessor by referencing to the previous plane and the new plane automatically determines the rotational edge and the direction of rotation to enter and execute the appropriate algorithm. In doing so, the particular lamps are changed from an existing color to that defined by the algorithm. By multiple direction edge rotation, each of the faces are successively revised to a common color. The microprocessor can be programmed for various levels of difficulty by the change algorithms, and different given levels can be provided in automatic sequence. The lights are flashed for each solution of the puzzle, with different displays for the different levels. Face circuit boards for each face are physically supported by the leads. A logic board and a multiplex driver board are arranged within the face boards and the boards are mounted within the cube and firmly locked within the assembly by the interlocking cube walls.

17 Claims, 6 Drawing Sheets

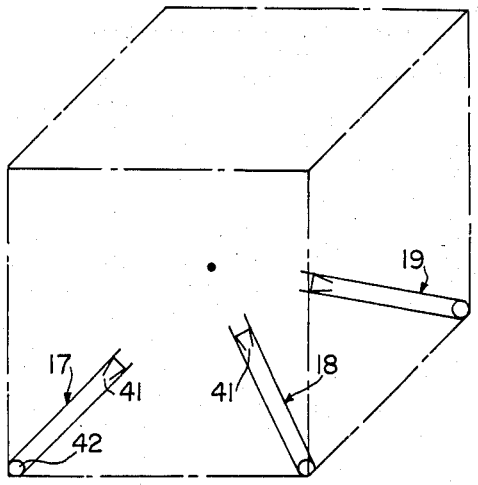
FIG.9
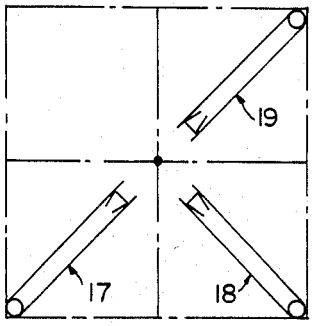
FIG.10
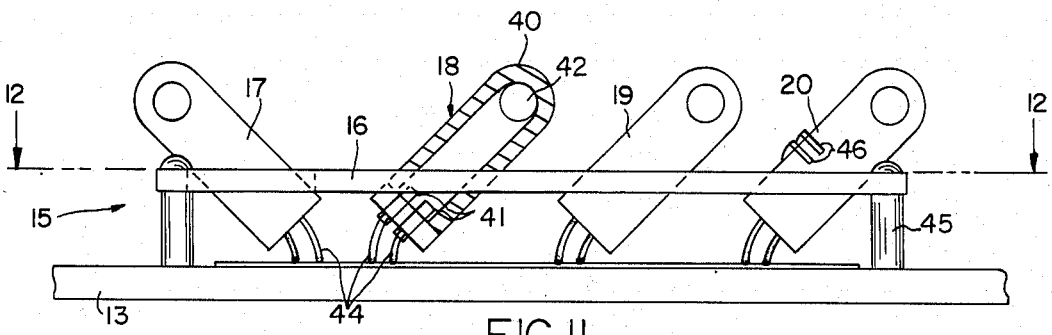
FIG.11
FIG.12
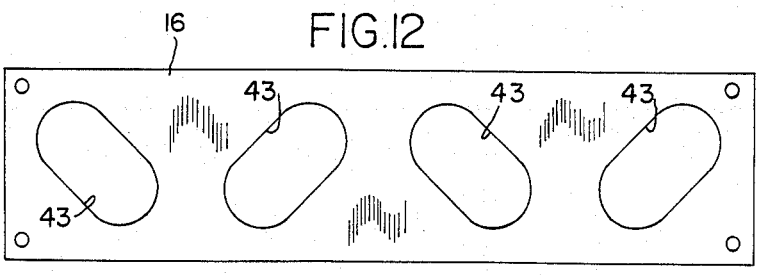

ELECTRONIC PUZZLE DEVICE

BACKGROUND OF THE PRESENT INVENTION

An appendix to this patent appears in the file wrapper including a microprocessor object code for executing a puzzle as described herein.

The present invention relates to an electronic puzzle device and particularly to such a device which is adapted to be manually manipulative and generating a motion responsive display for creating and maintaining user interest.

Various hand manipulated puzzle devices have been created in which the user manipulates one or more components for purposes of solving a puzzle. A most recent device is a "Rubic" cube in which rows and columns of colored elements are arranged for simultaneous planar movement. By appropriate manipulation of the various columns and rows in a given plane or face of the cube, each face of the cube can be arranged to show a single color display. The cube can be subsequently reorganized with random disposition of the various colored squares and the puzzles in essence reset for subsequent manipulation. Although there are a number of different solutions in connection with the puzzle, continued manipulation in solving the puzzle results in learning of the necessary sequence and procedures to rather rapidly solve the puzzle. Further, after a number of solutions, continued interest may be lost because of the repetitive sequence for solving of the puzzle. Another manipulative device including a visualized cube unit is disclosed in U.S. Pat. No. 4,575,087 which issued on Mar. 11, 1986. In the visualized cube, a light array is provided for illuminating a cube face. A predetermined sequence of switch closures established by movement of the cube compared to a programmed switch sequence results in an illuminated display defined as the solution of the visual cube puzzle. The puzzle solution again is controlled by a predetermined repetitive switch closure sequence of the puzzle in order to illuminate corresponding lights or the like. The visualized device again is dependent upon a specific repetitive sequence and the solution would appear to permit reasonably rapid development of the solution such that continued interest would be difficult to maintain.

There is therefore a continuing need and demand for a hand manipulated puzzle generally of the cube-type variety with means for establishing and maintaining various levels of interest and difficulty of solution to establish and maintain interest in the manipulation and solving of the puzzle system.

SUMMARY OF THE PRESENT INVENTION

The present invention is particularly directed to a motion based manipulative puzzle device having one or more display faces or including a plurality of display faces interconnected by distinct edges or areas of rotation. Each display face is provided with an appropriate changing visual display such as a plurality of different multicolor display lamps. By appropriate multiple edge rotations of the device to place each display face in a defined reference position, the various faces can be generated into a coordinated display defining a puzzle solution. In accordance with the present invention, the change in each display face is based on the directional rotation about one of the interface edges. The adjoining faces and the particular interrelated rotational edge defined by such faces includes a logical algorithm defining the particular display change for the face moved to the reference position. The logic control unit thus only need stores and defines the face locations to define the rotational edges. The algorithm is thereby related to the present display and a particular color change rule to produce a new display. In this manner, edge rotation of the element redefines the puzzle position and the particular rotation or rotations for solution of the puzzle. In particular, there is not one particular sequence established by the logic control system which must be followed to solve the puzzle. The logic of a particular solution of the many possible solutions can be understood with continued operation of the puzzle and with successive solutions of the puzzle, the player can develop the necessary skill to more rapidly solve the puzzle. The puzzle can be readily constructed to vary the solution level to various degrees of difficulty, either automatically or through a manual control.

Generally in a practical embodiment and construction, each display area is provided with a plurality of multicolor lamp units arranged in a predetermined array and each lamp unit is adapted to illuminate the aligned area in any one of two or more characteristics such as colors. The logical algorithm and control circuit includes the color change rules for changing like color lamp units of one color to a different color within the face group. Thus, assuming use of the colors red, yellow and green, one algorithm could change all greens to yellow and all yellows to red, with all reds held or locked to red. The above three color units are references herein after describing the present invention for simplicity and clarity of discussion. However, any other sensible multidisplay means may be used and are included within the scope and explanation of the present invention as set forth herein. The proper referenced directional rotation about the edges would result in a final display of a face in the single red color. When all six faces, for example are in the same color, the puzzle is solved. When the puzzle is solved, the lamp units can be specially activated to indicate the solution such as by providing flashing of lights sequential activating of the lights and/or faces or the like.

In a typical practical embodiment of the present invention, the device is made in the form of a cube. Generally, the cube device is oriented with the uppermost or top plane as the reference face to which the other faces are rotated. Each of the faces of the cube is divided into a corresponding array of display areas. Each area has a multicolor lamp unit which various energization combinations will generate the various colors used in the puzzle. For example, one energization of the lamp unit generates red, a second energization generates green and a third red and green energization generates a yellow display in that area. The logic control is preferably a microprocessor programmed unit. A spatial orientation control unit, such as a plurality of control switch units which are responsive to the particular orientation and location of the face in space with respect to the horizontal and vertical planes is connected to the processor to define the orientation of the cube in space and particularly define the upper horizontal face. The particular face being rotated to the top plane thus rotates about the common edge with the existing top plane face. The microprocessor stores in any given instance the face in the top plane with the multiple lamp colored display existing for that face, as well as the display existing for all other faces. Upon the rotation of the cube to move a new face to the top plane, the logic rule or algorithm for the directional movement about the corresponding common edge is automatically entered and executed upon the previously existing display of that face. In doing so, the particular lamps are changed from an existing color to that defined by the algorithm. By multiple directional edge rotation, each of the faces are successively revised to a common color, which is the defined programmed solution of the cube puzzle. Thus, the process continues with the existing random color display to a single color in steps of a defined color change per movement.

Each face may be provided with a separate position sensor identifying the location of the face with respect to the top plane. Alternatively, three switch units angularly oriented in space provide binary logic signals which can be used to identify the particular face orientation. When and only when the face moves to the top or reference plane are the switches actuated to identify that face as in the top plane. The microprocessor by referencing to the previous plane and the new plane automatically determines the rotational reference or edge to enter and execute the appropriate algorithm. In summary, the microprocessor continuously monitors the cube position and the location of each face with respect to the horizontal reference plane, and with a particular algorithm selected depending upon the face and the edge of rotation.

As previously noted, the logic control system can provide for various levels of difficulty with respect to the change algorithms. The system may require one or more solutions at a given level before proceeding to the next level of difficulty in automatic sequence.

The cube device is preferably constructed in a particularly unique practical implementation as a block box-like cube. The light units and the associated logic and power system including a supply battery are housed within the cube with the light units behind a face structure formed of a black translucent material. Upon activation of the device as by any desired motion, a motion responsive switch turns the device on, and the unit is maintained activated as long as there is motion within a given period. This thus permits activation of the device without the necessity of any external mechanical switching system. The time/motion response insures that the power supply is not dissipated if the puzzle is stored. Upon initial activation, a random color display of red, green and yellow lights appears on each of the several faces. The light units for each face may conveniently for example include eight units arranged with one in each corner in combination with an internal cross, one at each end of the cross with the cross interposed between the four corners. When the player manipulates the cube in appropriate sequence, the color changes are sequentially generated to develop corresponding color on each face. When all faces reach a corresponding color and the puzzle is thereby solved, the lights may provide a flashing display. The total result is a highly effective and interesting puzzle game operable to maintain the interest of the user over long periods of time. Although the microprocessor, electronic circuitry, lamps and the like may take any desired structural arrangement, the inventor has found a very convenient reliable and cost effective assembly which consist of forming circuit boards which are physically connected by suitable connecting lead assemblies which also provide physical support of the boards. Each of the circuit boards is of a generally similar rectangular construction, somewhat smaller than the face of a corresponding side of the cube. An individual lamp and logic board is provided for each face of the cube. In addition, there is a main controller board and a common driver board for activation of the lamps on the several faces. The boards are physically arranged within the cube member with the circuit lead assemblies interconnection and with the boards mounted in parallel orientation. This provides a complete, convenient and compact package for manufacture, assembly and maintenance.

Each of the face boards is provided with a lamp support as well as connection circuits for connection directly through the adjacent circuit board or through one or more of the other face boards to the driver board. The driver board and the main controller board are mounted in space parallel relation within the cube. The total assembly of circuit boards can be firmly clamped within the assembly by the interlocking cube walls to produce a rugged and operative puzzle unit.

The outer walls of the cube are formed of a rigid plastic with appropriate shaped light dispersion elements. The lamps are secured to the corresponding face boards to the back side of the wall structure for alignment with the dispersion elements.

The present invention provides a futuristic and challenging puzzle which can be of interest to players of various skill levels, and which can be constructed with present day technology.

BRIEF DESCRIPTION OF THE DRAWINGS

The drawings furnished herewith generally illustrate the best mode presently contemplated for the invention and are described hereinafter.

In the drawings:

FIGS. 9 and 10 are views illustrating the positioning of the puzzle cube position switches;

FIGS. 11 and 12 are views of a switch support plate for holding the position switches;

DESCRIPTION OF THE ILLUSTRATED EMBODIMENT

Figure 1:
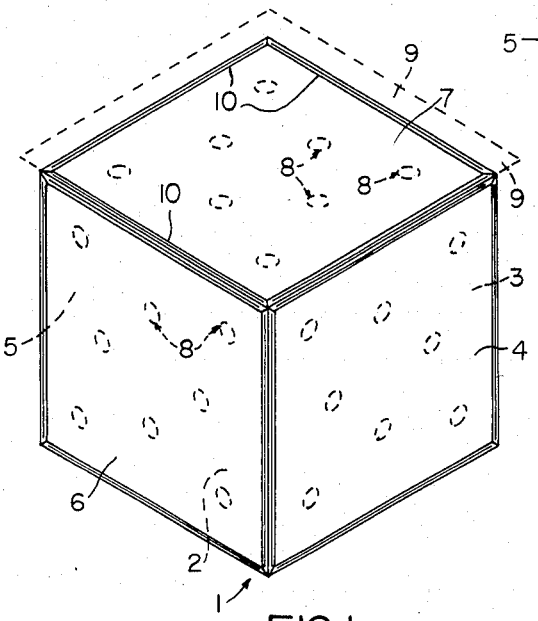
FIG. 1 is a pictorial view of a puzzle cube constructed in accordance with the teaching of the present invention.
Figure 3:
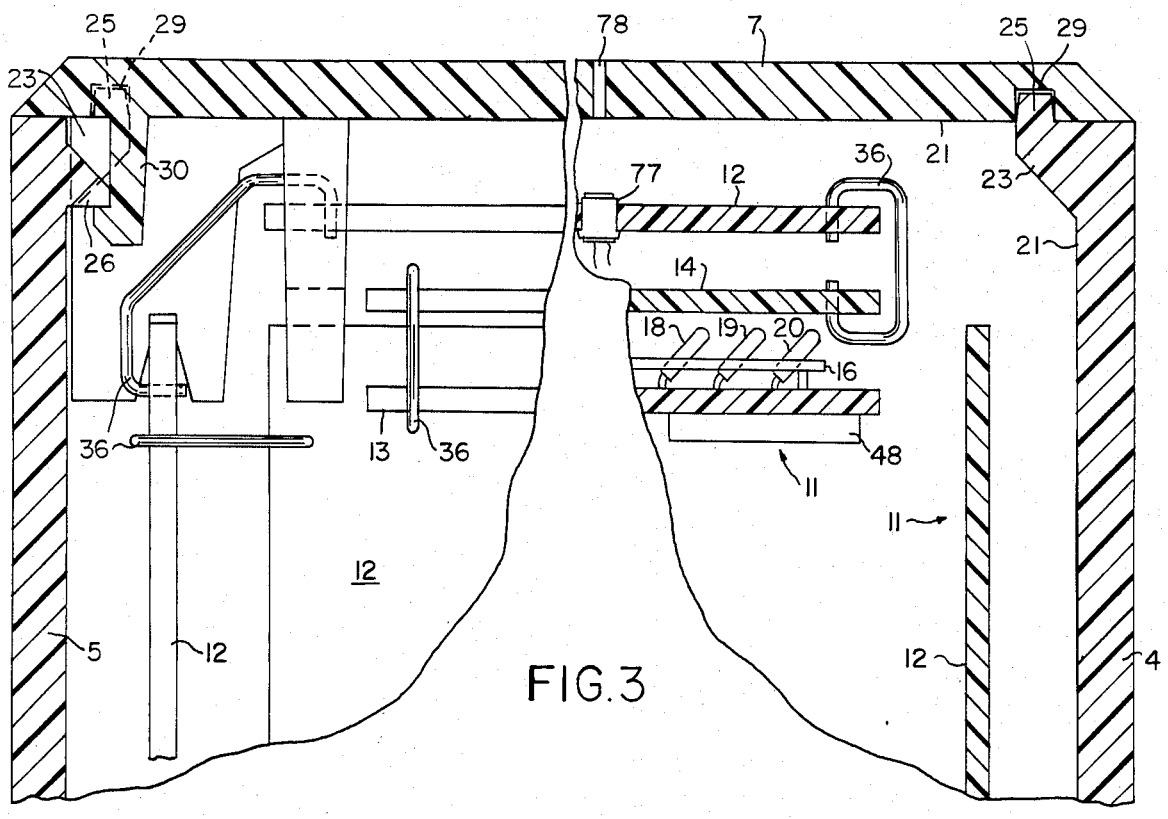
FIG. 3 is a sectional view taken generally on line 3—3 of FIG. 2.
Figure 6:
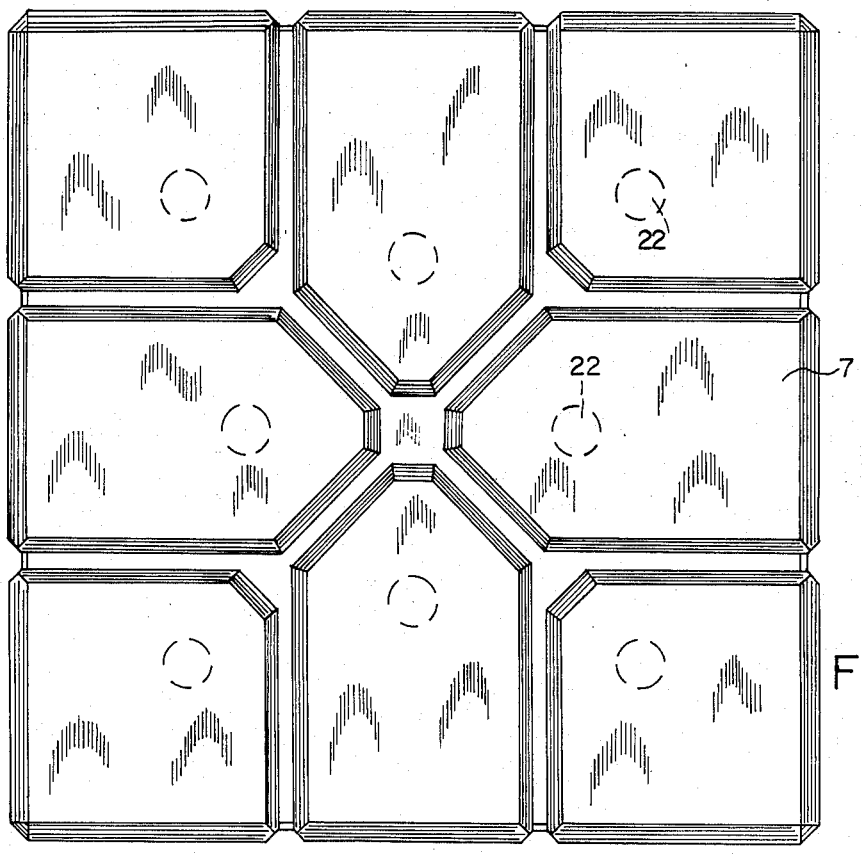
Figure 13:
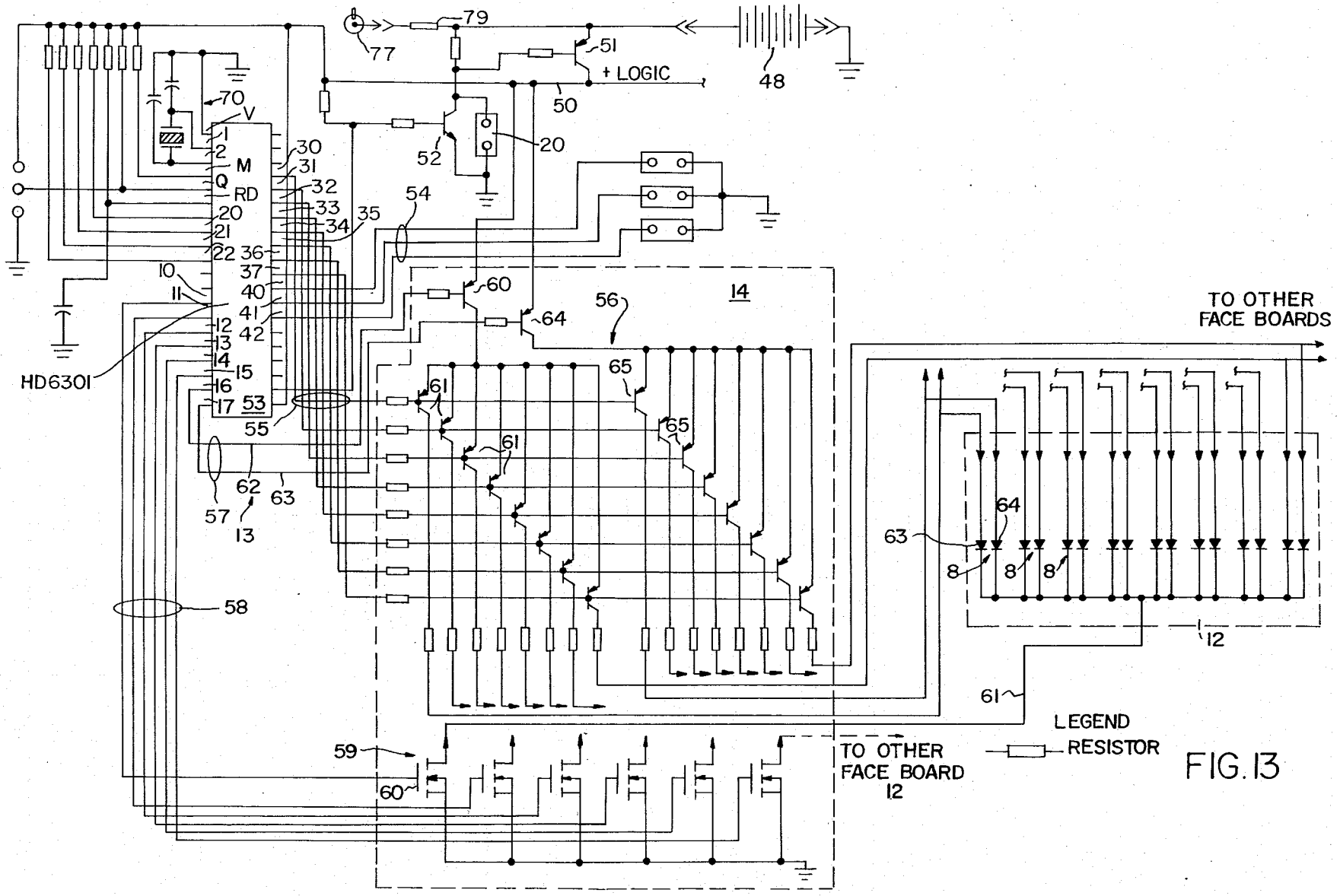
FIG. 13 is a schematic circuit diagram of the puzzle illustrating the microprocessor circuit and its interconnection to the flow to the several circuit boards.

Referring to the drawings and particularly to FIG. 1, a cube 1 is illustrated with each of the six walls or sides 2 through 7 correspondingly constructed with a plurality of corresponding display units 8. In the illustrated embodiment of the invention, each display unit 8 is a multi-filament lamp unit which is adapted to be selectively energized for generating one of a plurality of different colors. The puzzle cube is manually manipulated in respect to a top horizontal reference plane 9. Thus, any one face of faces 2–7 is located essentially in a top horizontal plane and constitutes the reference face. The puzzle solution is developed by rotating of the cube about a top edge 10 to replace the present top face with one of the adjacent side faces. A logic control unit 11, preferably on electronic microprocessor based control system as shown in FIGS. 3 and 13, , is mounted within the cube 1 and functions to energize the several lamp units 8 on the six faces, as more fully developed hereinafter, and to respond to the rotation about an edge 10 to change the illumination of the lamp units 8 on the new reference face moved to plane 9. In the illustrative embodiment of the invention, change continues until such time as all lamp units 8 in all faces are a common color. The logic control unit 11 includes a plurality of different color display rules establishing the sequence of color change of the units 8, and each edge 10 of the cube has a pair of such rules assigned to it. The two rules establish a direction of rotation response. The logic control unit 11 also stores or monitors the color of the several faces so as to determine whether or not the puzzle has been solved. Thus, the logic unit 11 need not compare or monitor the sequential movement, but need only create the display change and monitor the result of such change.

The control system 11 is motion responsive in that it provides for automatic turn-on of the unit in response to significant moving of the cube 1.

Figure 4:
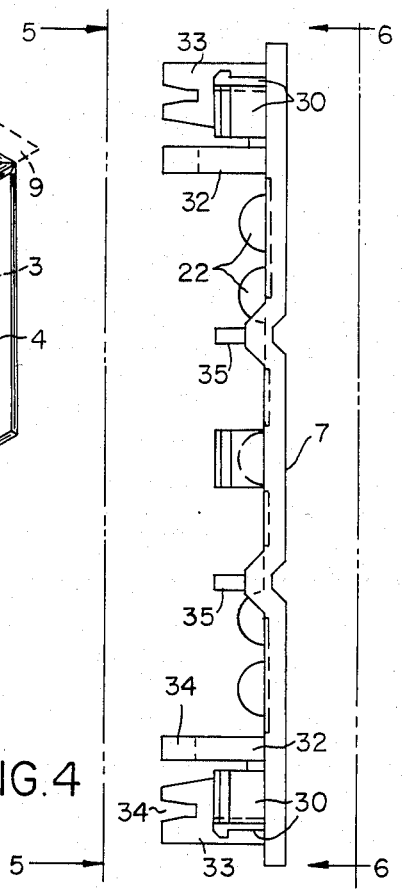
FIGS. 4–6 are views of the cube and top wall as shown in FIGS. 1 and 2.

The lamp units 8 for each face are similarly mounted on a face circuit board 12 (FIGS. 3, 4 and 13), which is secured within the cube housing in parallel spaced relation to the corresponding side. A processor board 13 and a driver board 14 are secured within the center section of the housing.

A bank 15 of four switch units are secured to the one circuit board 13. The switch units are mounted in spatial orientations in a support plate 16 such that three switches 17, 18 and 19 define a logical binary output identifying the top face in plane 9 and the fourth switch 20 is a motion sensitive to automatically power-up the control system in response to significant movement of the cube. The several boards 12–14 are interconnected to provide the necessary logical response to the movement of the cube to solve the puzzle.

The cube housing is formed with the six separate walls 2–7, which are identified in the illustrated embodiment, including four similar side walls 2–5 and similar top and bottom walls 6 and 7. The several walls are specially constructed for a snap interconnection for convenience of assembly and manufacture. The top and bottom walls 6 and 7 are further constructed for plug-in mounting and clamping of the necessary circuit boards within the cube for supporting of the operating and control components of the display and control and power systems and defining a self-contained operating unit.

More particularly, the four side walls 2–5 are constructed for edgewise interconnection to form a rectangular tubular member to receive the top and bottom walls 6 and 7.

Figure 7:
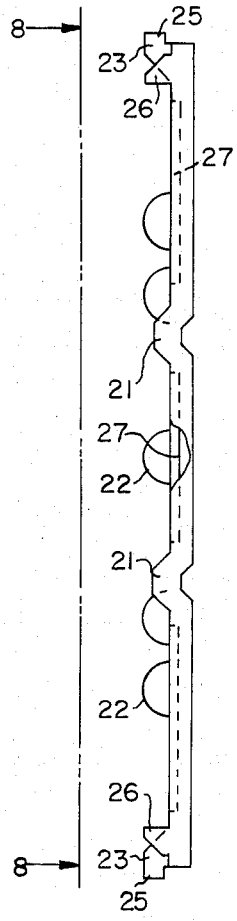
FIGS. 7 and 8 are views of the cube side wall of the cube as shown in FIGS. 1 and 2.
Figure 5:
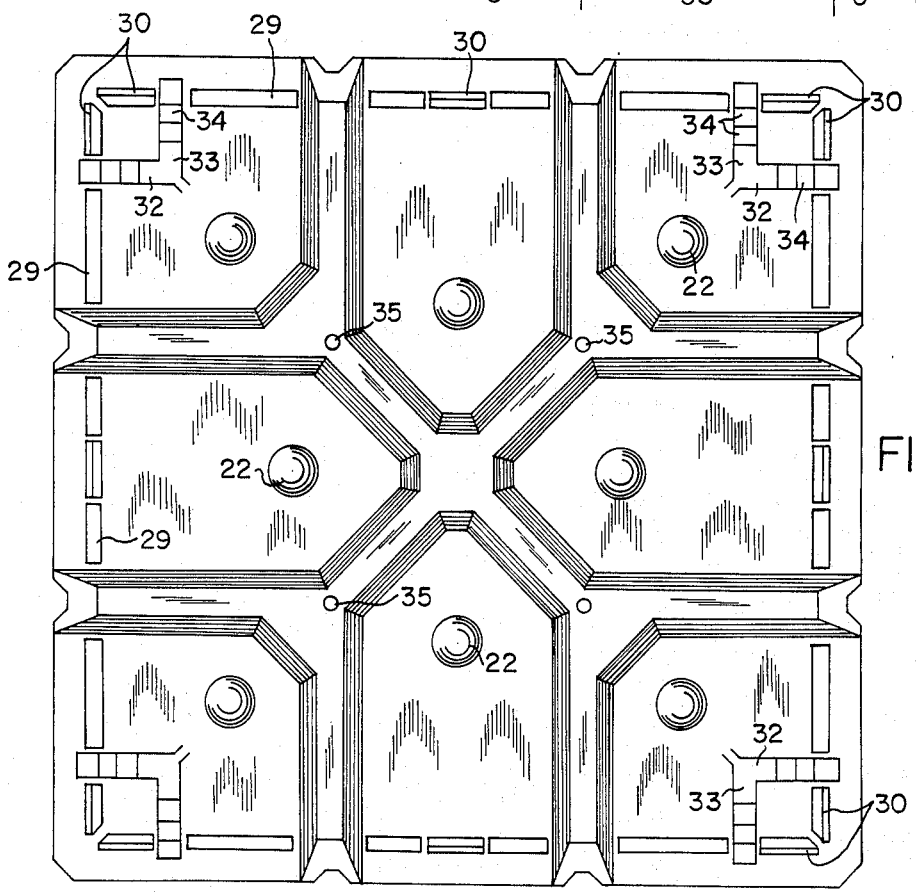
Figure 2:
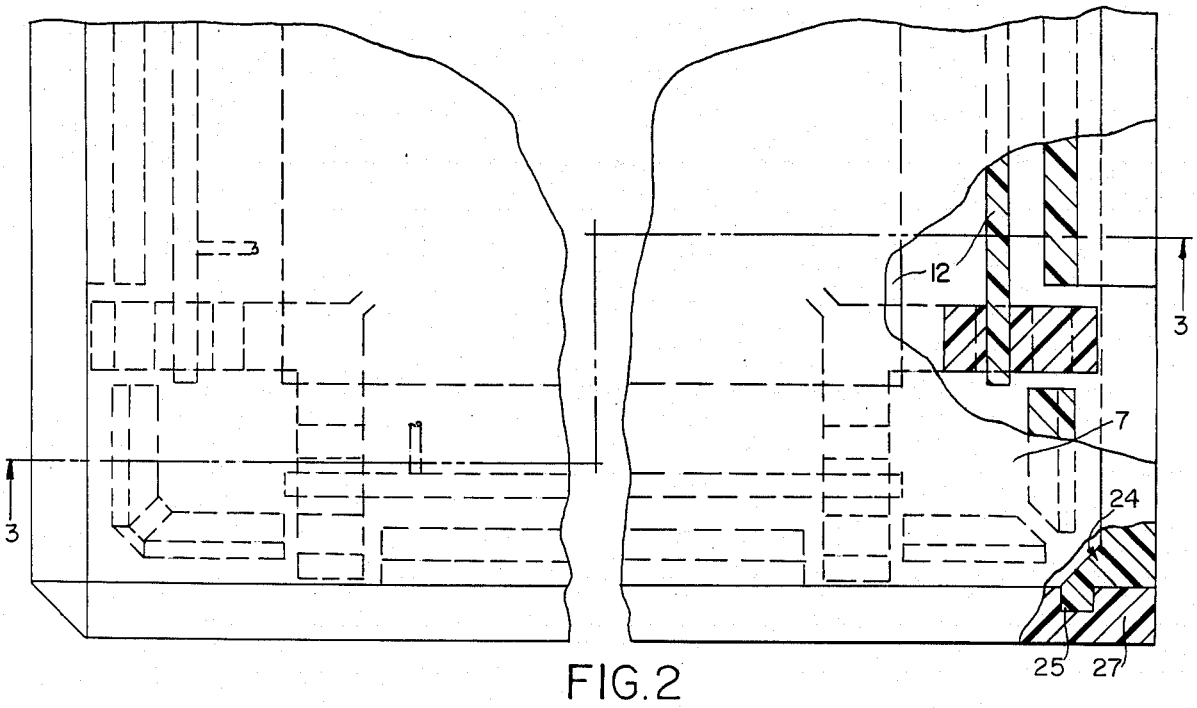
FIG. 2 is a fragmentary plan of the cube puzzle shown in FIG. 1 with parts broken away to show detail of construction.
Figure 8:
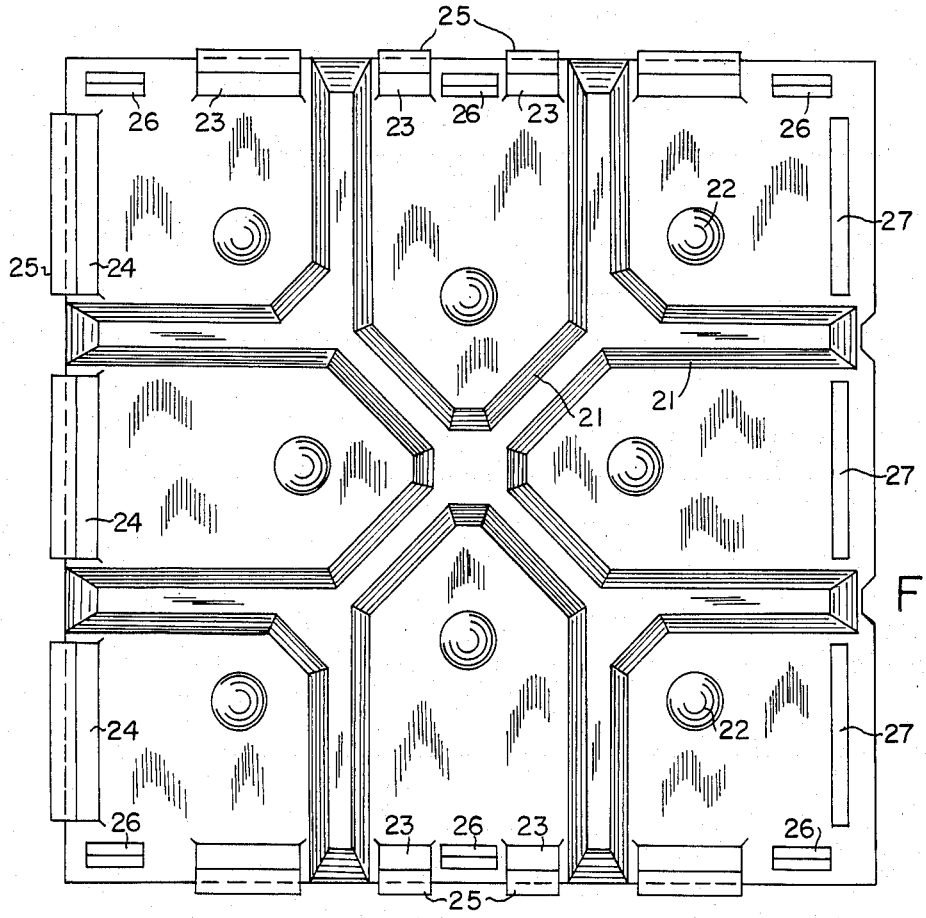

Each side wall is constructed as shown in FIGS. 7 and 8. The side wall 2 is described and is formed as a molded plastic plate-like member of a suitable opaque plastic such as SAN tinted clear plastic. The inner surface of the side wall 2 is formed with raised ridges 21 defining individual light areas for developing an individual light presentation. The outer face is similarly defined. Each area is shown formed with an integral lense portion 22 which projects inwardly for transmission of light from an aligned lamp unit 8. In the illustrated embodiment of the invention, each face is provided with eight distributed display areas and light units 8. The eight light units are distributed with a first group of four arranged and defining a square configuration as shown in FIGS. 1 and 8. The second group of four units 8 are similarly arranged in a smaller square configuration rotated 45° with respect to the first group of light units, such that each of the lamp units of the second group are located between two of the lights of the first group and spaced inwardly slightly therefrom.

The four peripheral portions of the side wall and particularly the inner surfaces are formed with interlocking projections and grooves for snap connection. Thus referring particularly to FIG. 8, three side edges of the side wall includes a plurality of longitudinally spaced latch arms 23 projecting perpendicularly inwardly of the side wall. The opposed top edges includes different sized arms 23 while the other side edge includes spaced similar arms 24. Each arm 23 and 24 has the outer end formed with an outwardly projecting lip 25. The same edges of sidewalls 2 further include inwardly projecting locating members 26 located between the latch arms 23. The fourth side edge includes three spaced recesses 27. The recesses 27 and projections 25 of arms 24 on the other side walls are aligned with respect to those of the opposite adjacent edge. The side edges of adjacent sidewalls 2 can thus be oriented with the edges aligned such that each interlocking snap arm is aligned with and mates with a recess 27 to form a mechanical interlock, as shown in FIG. 3.

Each top and bottom wall 6 and 7 is similarly constructed as a flat plate-like member having the offset ridges defining the same visual display areas as in the case of the sidewalls 2–5, as shown in FIGS. 2–6. The four sides of wall 6 includes locating and stabilizing recesses 29 formed on the interior surface. The recesses are spaced in accordance with and complement the edge projections 23 and the top and bottom edges of the sidewalls 2–5.

In addition, each wall 6 and 7 is provided with small inwardly projecting latch arms 30 spaced inwardly from the edge of the corner and generally in accordance with latch arms 26 of the sidewalls 2–5. The arms at each corner thus form interlocking members for coupling to the locking arm of the sidewall.

In addition, each corner of the top wall 6 is provided with a pair of perpendicularly oriented circuit board support walls 32 and 33 and defining an L-shaped wall unit which project inwardly from the top wall. Each support wall 32 and 33 includes an inner end notch 34. Each edge portion of the wall 6 is thus formed with the spaced aligned walls at the opposite end for receiving of a face circuit board 12. The circuit boards 12 are a conventional rigid plate-like boards with the light units 8 and with selected associated circuitry mounted thereon. The walls 32–33 are each formed with the edge notch 34 adapted to firmly grasp the edge of the circuit board. The circuit board 12 is forced into the notch 34, and is rigidly and firmly held in location extending parallel to the inner face of the side wall.

In addition, each top and bottom wall 6 and 7 includes four stakes 35 adjacent center lens 22. The top and bottom face circuit boards 12 are heat staked to stakes 35 to firmly mount the boards in place.

The light system and the electronic logic control system are mounted on the plurality of similar circuit boards 12–14 mounted within the outer cube housing. Eight circuit boards are used, including six similar face boards 12 which are secured to the corresponding cube sides, a driver board 14 including the logic for driving the lamp units 8 on the several face boards and the control board 13 including the control logic and power system.

All lamp units 8 are corresponding devices. Thus each unit, as illustrated, is a dual color LED chip, such as sold by Rohm Corporation of Irvine, Calif., 92714 under the model SLM-23rmw. The LED chips are mounted directly onto the face board 12 in appropriate alignment with the display lenses 22. The LED chips 8 are arranged on the board for appropriate alignment with the lenses.

Alternatively, a device has been constructed using dual filament lamp units such as available from Panasonic of Japan under Part No. LN11WP23. The units are physically mounted to the circuit board and hard wired onto the circuit. The units can be mounted in any suitable manner such as by a hard wiring to the circuit board, and the wires forming the necessary physical support and connection of the LED.

In the assembled relation, the fur face circuit boards 12 adjacent the four sidewalls are physically supported in place by the L-shaped clamping walls 32 and 33 and to walls 6 and 7 by stakes 35. In addition, each of the circuit boards 12 are connected to the adjacent circuit boards 12 by relatively heavy lead connectors 36. The connectors may be a plurality of individual leads or a ribbon cable having the appropriate internal leads for connecting of the circuits, as hereinafter discussed. The leads establish a relatively stiff assembly as illustrated which provide physical support for the several circuit boards. The top and bottom circuit boards are secured to the top and bottom walls as heat staking which physically supports such boards in spaced relation to the side boards.

The circuit boards are thus formed as eight separate boards. The four face boards corresponding to the four side walls are connected to each other in alignment with the controller and driver boards 13 and 14 secured to the one end thereof. The top and bottom face boards 12 are secured to the opposite sides of the two center sidewall face boards. In assembly, the bottom face board 12 is staked to the bottom wall 7 and the four sidewall face boards 12 are reoriented in a rectangular configuration with the controller board and the driver board folded inwardly into the square configuration such as shown in FIG. 3. The sidewalls 2–5 are assembled into a tubular member and slipped over the boards 12–14 and secured to the bottom wall 7. The top face board 12 is staked to top wall 6 and then folded to overly the configured sidewall and control boards. The top wall 6 is then secured to the top of the sidewalls 2–5 to complete the assembly.

As previously discussed, the orientation of the puzzle cube with respect to a reference plane 9 is required. In the illustrated embodiment of the invention, the bank of switches 15 is held in spacially distributed orientation to monitor the position of the cube 1 with respect to the top reference plane 9. In the illustrated embodiment of the invention, the fourth switch 20 is coupled to the bank of switches 15 to provide a motion sensor for initiating the circuit operation when the user first picks up the puzzle and for manipulation thereof in solving of the puzzle.

More particularly, each of the orientation switches 17–19 are shown as a well known elongated mercury switch unit. Each switch unit is a single pole, single throw switch including an outer tubular enclosure 40 with a pair of contacts 41 in one end. A mercury ball 42 within the enclosure is adapted to bridge the contacts and close the switch. The mercury ball only bridges the switch 18 when the switch is held in appropriate orientation such that gravity causes the ball 42 to move downwardly into bridging engagement with the switch contacts. This provides an on/off switch operation with positioning of the cube and provides the conventional binary logic signals as hereinafter described.

The three switches 17–19 are oriented with respect to the cube such that they are located at any time on diagonal lines from three corners of the cube, as diagrammatically illustrated in FIG. 9. The switches 17–19 thus extend on a diagonal line of the cube from three bottom corners. In the illustrated embodiment, the contacts 41 are shown in the upper raised portion whereby all three balls are at the bottom most position. The switches are located in all three spacial planes at an angle of essentially 45° from the surfaces of the cube. For example, in a top view, (FIG. 10) the three switches are at 45°, or on diagonal lines between the four corners. In a corner-to-corner plane, the aligned corner switches appear at 45° to the horizontal and vertical surface. The centrally located unit would also extend at a similar angle 45° to the vertical and horizontal walls.

The three switches 17–19 are rearranged in an in-line orientation in the slotted support board 16 with angled slots 43 as shown with the three switches orientated as shown in FIGS. 11 and 12. The slots in a practical construction for example, are approximately $\frac{1}{4}$ inch wide, 7/16 inches long with end a radius of $\frac{1}{8}$ inch. The tubular or elongated housing 40 of each switch is clamped into the slot with a pressure engagement and with the contact leads 44 hard soldered to the adjacent circuit board. The switch board 16 is secured to the circuit boar by a plurality of rigid spacers 45. The combination of the slot configuration and the wired connection of the switches establishes a firm, reliable physical support for the switches. The three switches 17–19 develop the necessary logic for identifying the position of the top face. With the illustrated or switch orientation, the logic table for the several faces is as follows. (Switch open=1; Switch closed=0):

| | SWITCHES | | |
|---|---|---|---|
| Face | 19 | 18 | 17 |
| 7 | 1 | 1 | 1 |
| 6 | 1 | 0 | 0 |
| 2 | 0 | 0 | 0 |
| 3 | 0 | 1 | 1 |
| 4 | 0 | 0 | 1 |
| 5 | 1 | 1 | 0 |

The bank of switches include the fourth motion sensing switch 20 which is also shown as a single-pole, single-throw mercury switch. The switch is set at 45° from all three axis and has its contacts 46 located at the midpoint of the enclosure. Consequently, any movement of the cube to reorient the cube 1 with a new face in the top plane 9 will cause the mercury 42 to move from the one end to the opposite end moving past the contacts. The mercury 42 therefore bridges the contacts and establishes a momentary closure of the switch, 46 during rotation which moves a new face to the to top surface or upon any other type of vertical shaking type movement of the switch.

The motion sensitive switch 20 is connected into the circuit to close the power connection from a power supply battery 48 to the control system. The battery 48 is shown mounted to the board 13. Once the circuit is turned on, the power supply is locked into operation. A timer unit is included logic unit 11 to turn off the power supply if the cube is not moved within a selected time period.

A schematic circuit diagram of the electrical system for the illustrated embodiment of the invention is set forth in FIG. 13.

The circuit is battery driven and may use one or more small batteries such as widely used in commercial practice. The inventors used four double "A" sized NICAD batteries in one construction. The negative side of the battery 48 is connected to ground and the positive side of the battery 48 is connected to a regulating transistor 51 to establish a B+ logic line 50 to the control system. The motion sensitive switch 20 is connected to the battery 48 and when closed turns the transistor 51 on. An interlock transistor 52 is connected in parallel with the motion sensitive switch 20 to lock the circuit to the supply upon momentary closure of the motion sensitive switch.

The schematic circuit includes a microprocessor 53, such as a HD6301. The processor 53 includes a group of input lines connected via signal lines 54 to the position sensitive switches 17–19 to continuously monitor and record the positional state of the puzzle cube 1.

The group of output lines 55 are connected to the color driver switches 56 mounted on the color driver board 14 and connected the face boards 12 for energizing of lamp units 8. A pair of output lines 57 select the energization of the red or green filaments of the lamp units 8, with the bank of switches selectively selecting the particular lamps on a given face which are to be energized and de-energized. A second group of output lines 58 from the processor are coupled to the face driver board selection switches 59 to select the particular face 2–5 which is energized.

More particularly referring to the color driver board 14, a red color driver transistor 60 is connected to the logic supply line 50 and to a bank of individual lamp unit transistors 61 of switches 56. The input of the red color drive transistor 60 is connected to a color driver line 62 of lines 57 from the microprocessor 53.

The color driver line 63 of lines 57 is similarly connected to control a green color drive transistor 64 which is connected between the logic power supply 50 and a bank of transistors 65.

Each driver 55 line establishes selective energizing of any one or more of the eight lamps 8 on a given face 2–7. Thus, the transistor 60 and 64 respectively provide power to the individual lamp drive control transistors 61 and 65. Each of the eight individual drive transistors 61 and 65 are shown as standard PNP transistors with the emitters connected in common to each other and to the collector of the transistor 60 and 64. The base of the transistors is connected to the selection output line of the microprocessor. If the number one lamp unit 8, for example is to be energized, power is supplied to the base of the transistor 61 turning that transistor on simultaneously with the transistor 60. The simultaneous conduction of transistors provide output power via a collector resistor to each and every one of the number one lamp units on all six faces, and particularly the red filament of all such LED units.

Six field effect transistors 59 are shown, mounted on the driver board, one for each of the cube faces 2–7. Each of the FET transistors 59 has on gate 60 connected to a separate face selection line 58 from the microprocessor 53. The transistor 59 has its collector to emitter circuit connected to a common return line 61 to the face boards to complete the circuit through the corresponding LEDs 8, which are receiving power from the color driver transistor 61 and 65.

In the illustrated embodiment of the invention, the face circuit boards 12 are similarly constructed with the lamp units 8 mounted thereon. Each lamp unit has a red filament 63 and a green filament 64 with individual and corresponding inputs connected to the driver transistors 61 and 65 respectively. The opposite side of all filaments 63–64 on one board 12 connected in common to each other and to all other filaments on the board. The common connection is connected to a corresponding control line 61 to complete the drive circuits to the filaments.

The illustrated circuit provides a multiplexing system wherein the transistors 61 and 65 are selectively turned on to drive particular color filament is to be energized, recognizing that both filaments are energized to generate the color yellow. Thus, as the processor multiplexes the lamp energization with alternative energizing of the red and green filaments create the yellow color.

The motion sensitive switch 20 controls the turn on of the system. The microprocessor reads the status of the position switches 17–19 monitors of the position of the faces 2–7, and particularly the identification of the top planar face. The rotation of the cube about a vertical axis of the cube does not effect the position sensitive switches 17–19 and consequently does not change the system operation. Rotation of the cube however about a horizontal axis results in movement about a common horizontal edge 10 of the new face to the top or reference plane. The change in orientation changes the binary output of the position sensitive switches 17–19. The processor reads the change and recognizes and identifies the new top plane face, and also the direction of rotation. The memory map for the LEDs 8 on the new face are changed in accordance with a programmed logic, with the light change colors being set in accordance with a particular one of a plurality of specific logic rules or algorithms. The specific rules invoked are defined by edge rotation and the resulting light pattern is observed by the game player. The object is to rotate the cube until all six faces are the same color. The use of three colors thus generates three different basic puzzles, each of which are preferably programmed to require a different patterns of rotation. Further, the system is preferably programmed to have two different levels of difficulty of play such that there is in fact six different puzzles. The system is further preferably programmed such that the user may solve the puzzle in a sequence including solution for all first three colors in a at a first level and thereafter at a second level of complexity wherein three colors are again solved but with a more complex solution. The complexity of the solutions may also, for example, follow at a first level, a hierarchy of complexity of red, green and yellow. Thus, it may be easier to change all of the units to a red color than to a green color and similarly it is easier to form a green cube than a yellow cube.

The microprocessor is a standard microprocessor which will be readily recognized by those skilled in the art. The processor includes a self-contained computer system including appropriate fixed programmed memory as well as a read/write memory for monitoring and continuously updating the information received from the inputs and read/write memory, input/output buses, oscillator and timer. The processor operates and executes a fixed operating logic to perform the system function and the total system control and intelligence resting in the processor. The processor reads and decodes the position switches to determine the face and continuously stores information as to the connection of the faces.

In the illustrated embodiment of the invention, there are eight dual element LEDs, each of which is addressed on an individual basis. The status of each of the lamps is stored in the R/W memory unit for identifying the status of each lamp and the corresponding face or sidewall. The transition algorithms for any given puzzle is based on sequentially converting of the lamp units 8 from one color toward the final color. For example, assuming the simplest solution is to be executed, that is, converting all faces to red. The transition algorithm is a two part rule including a first part in which all green units are changed to yellow. The second part of the rule changes all yellows to red thereby establishing the red color for the face. The two parts are sequentially executed in that order upon appropriate edge rotation of the cube.

The two part rule may be diagrammed for the green to yellow and yellow to red rule and summarized as follows:

TRANSITION ALGORITHM = Green (G) to Yellow (Y) to Red (R) and Red to Red (R)
Light Units 8

| | 1 | 2 | 3 | 4 | 5 | 6 | 7 | 8 | |
|---|---|---|---|---|---|---|---|---|---|
| | 1 | 1 | 0 | 1 | 0 | 0 | 1 | 0 | Green filament |
| | 0 | 0 | 0 | 0 | 1 | 1 | 0 | 0 | Red filament |
| Color Pattern | R | R | Y | R | G | G | R | Y | |

The red register are complemented and stored into the green registers to perform the yellow to red transition.

| | 1 | 1 | 1 | 1 | 0 | 0 | 1 | 1 | Green filament |
|---|---|---|---|---|---|---|---|---|---|
| | 0 | 0 | 0 | 0 | 1 | 1 | 0 | 0 | Red filament |
| Color Pattern | R | R | R | R | G | G | R | R | |

The red register is cleared and stored in the green register to perform the green to yellow transition and thereby complete the transition:

| | 1 | 1 | 1 | 1 | 0 | 0 | 1 | 1 | Green filament |
|---|---|---|---|---|---|---|---|---|---|
| | 0 | 0 | 0 | 0 | 0 | 0 | 0 | 0 | Red filament |
| Color Pattern | R | R | R | R | Y | Y | R | R | |

The face has now only red and yellow displays portions.

On the next execution of this color algorithm, the yellows are changed to red and the face is solved to the solid or all red display.

| | 1 | 1 | 1 | 1 | 1 | 1 | 1 | 1 | Green filament |
|---|---|---|---|---|---|---|---|---|---|
| | 0 | 0 | 0 | 0 | 0 | 0 | 0 | 0 | Red filament |
| Color Pattern | R | R | R | R | R | R | R | R | |

Further execution change red to red.

The other similar algorithms which might be selected to provide for a color change in some other sequence or transitions includes from red to yellow to green, from yellow to green to red, from red to green to yellow, from green to red to yellow and from yellow to red to green.

The four faces extending about the cube in one place may then be solved by appropriate rotation in that plane. However, the opposite end faces would require special edge rotations. In practice, the end faces of the solution would generally have to be separately placed in the proper color such as all red followed by the planar rotation of the other four surfaces or faces therebetween rotated to the reference plane by rotation about the one horizontal axis.

The multiple display characteristic of each display unit 8 thus establishes a plurality of different color change sequences or rules which can be created by the control logic. In addition, the above sequences can be further modified. For example, the above all red algorithm may be modified to have an ending in a wrap on the original green, or with an ending in a wrap or on yellow. Further, the other algorithm can similarly have the various wraps or locks established, thereby establishing many various combinations to be assigned to the rotational edges. Further, by introducing and assigning a random color algorithm or rule to one or more edges, the complexity of the puzzle can be further controlled. Further, the complexity of the puzzle can be programmed to vary with any desired play characteristic such as the solution of one or more of the possible color-related solutions, the time of play and the like related factors so as to establish and maintain maximum player interest. In a preferred construction of the present invention, a pair of algorithms are assigned to each rotational area or edge 10 of the cube. Each assigned edge algorithm is also directionally related and such that the algorithm thereby also defines one of the common edge faces. For example, faces 2 and 6 include an edge appropriately identified as 2–6 or 6–2. With face 6 in the illustrated top plane, rotation of the cube about edge 2–6 to place face 2 in the top plane invokes a given algorithm. With face 2 in the top plane, rotation about edge 2–6 to place face 6 in the top plane invokes a different algorithm. In the simplest puzzle arrangement the algorithm are inverse of each other.

The four faces extending about the cube in one plane may then be solved by appropriate rotation in that plane. However, the opposite end faces would require special edge rotations. In practice, the end faces of the solution would generally have to be separately placed in the proper color such as all red followed by the planar rotation of the outer four surfaces or faces therebetween rotated to the reference plane by rotation about the one horizontal axis. By assigning distinctly different algorithms to the edges, the complexity of the puzzle can be varied significantly. Further, although any given puzzle can have one simplest rotational solution, each puzzle will in fact have a myriad of different solutions requiring the user to recognize the spatial organization of the puzzle faces in relationship to each other and the edge rotational movement. Thus, the logic control unit does not establish a particular required solution sequence. Further, the complexity of the puzzle can be decreased or increased by use of lesser or greater number of variables designed into the display units. Thus, changing the color combinations within each display unit will change the available color rule changes and thereby the possible level of complexity and difficulty which can be created in the puzzle solutions. Further, the plurality of display units within a given display portion or face could be placed in subgroupings with different color rule changes. Thus, the present invention with the plurality of rule changes and the combined edge and directional rotation based rule selection provides a puzzle which can be designed with a widely varying level of play so as to permit interesting play by players of widely different levels of skill and practice.

Once established with all faces converted to a proper color, the controller establishes an output indicating the solution, which may include a continuous flush color program for the cube indicating a proper solution, a flicking, of the lights or other such indication of a solution.

The system operation is generally summarized as follows.

When the cube 1 is picked up, any significant motion is sensed by the motion sensitive switch 20. The momentary closure of the switch 20 provides power to the latch transistor 52 from the CPU 53 and the logic and control board 13 and color driver board 14 are locked to the power supply. A reset circuit and associated CPU timer allows an oscillator 70 to stable and thereafter allows the processor to execute the operating software. The processor particularly provides power to the latching transistor to maintain uninterrupted battery power to the system circuits during the operation of the puzzle and also addresses the position switches 17, 18 and 19 to identify the upper or top face of the puzzle. In this stage, the puzzle for all practical appearance is off and none of the lamp are illuminated. Rotation of the cube 1 to introduce a new top face in plane 9 generates a random colored pattern for each face in memory processor 53 energizes the several selection lines 55 and 57 and the board lines 58 to turn on the appropriate red and green LEDs 63, 64 in a cyclical repetitive manner. The puzzle is then lit with each of the faces having a random pattern of red, green and yellow colors. Rotation to establish a new face 2–7 in the top reference plane 9 is sensed by the processor which then proceeds to calculate, based on the proper algorithms, any change in the color pattern. The processor resets the memory to properly change the color pattern for the new top face. After completing that face color change, the processor monitors its stored reference of the several faces to determine whether the puzzled is solved to a particular color. If the puzzle is not solved, the processor waits for rotation of the cube to enter a new top face and then proceeds to determine the change color for that top face, after which it again checks to see if the puzzle is now solved, and also steps to the time out routine. It thus continues to monitor and respond to the changes and orientation of the cube to present the new faces until the puzzle is solved. When solved, it enters into a locked mode for operating of the lamp units in a special mode in a special manner. For example, in this mode, the processor ignores any further puzzle rotation of any kind for at least a predetermined timed period. Thus for example, for 30 seconds to a minute after solving of the puzzle, the processor can provide a rapid turn on and off of the lamps in the solved color. The processor may record the solution of the particular color to prevent the solving of the same puzzle on the next rotation of the puzzle but allow establishing a different color puzzle. When all three colored face puzzles are solved, the processor may be and preferably establishes a second and more complex level of solutions. Thus, in the second level, each of the colors might again be established as solution to the puzzle, but the program can make it more difficult to do so by assigning the algorithms with a more complex pattern of rotations about the edges, assigning of random color edges or the like. Each of the more complex solutions can generate a further form of a display.

When all six puzzles have been solved, that is, all three at each level, a very special light show can be generated by the processor.

Figure 14:
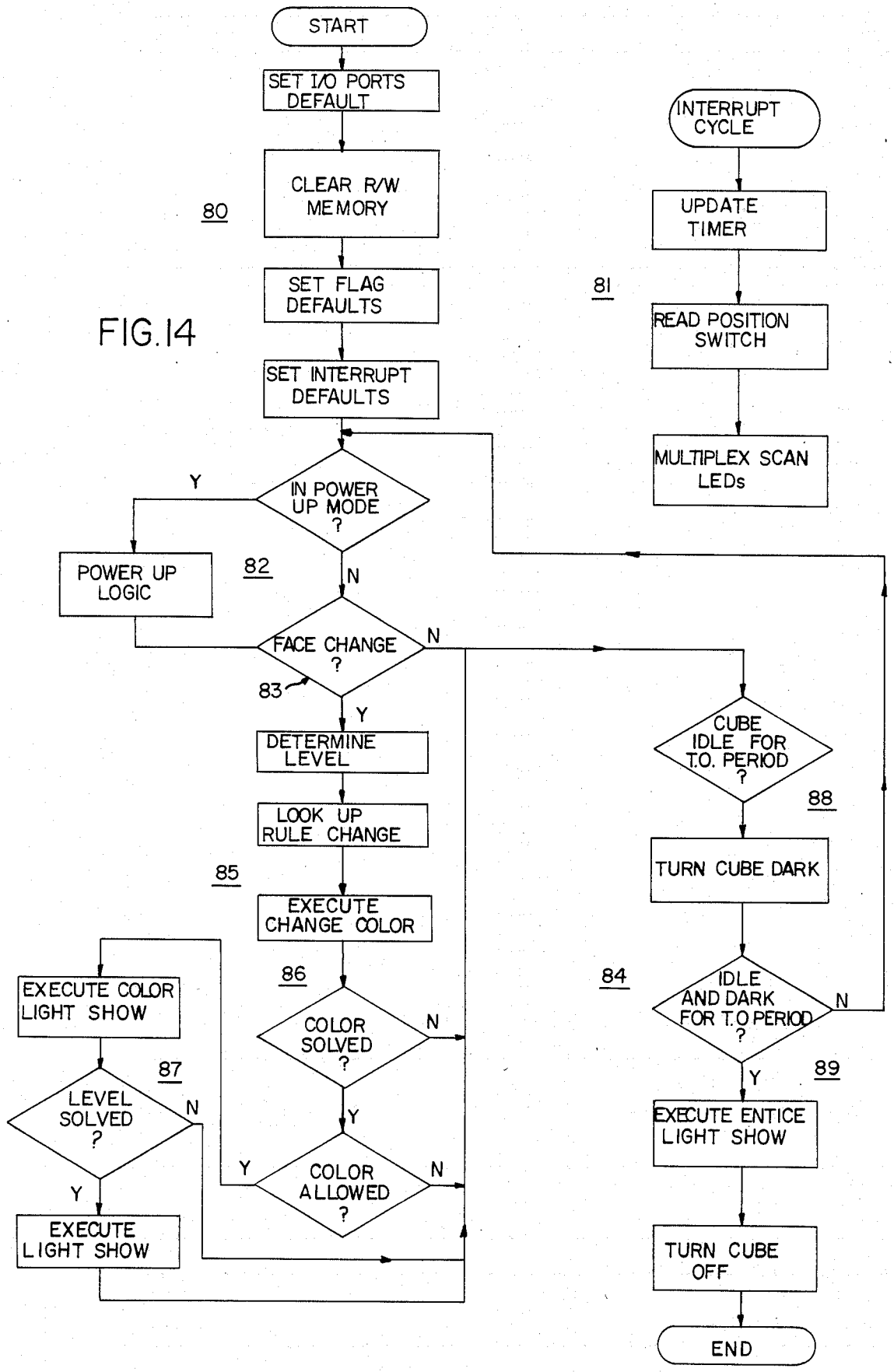
FIG. 14 is a flow chart illustrating the microprocessor sequencing and response to the puzzle changing movement of the illustrated embodiment of the invention.

The batteries 48 can be rechargable battery units. Such batteries are readily available with life approaching two hour when used in a system such as shown herein. The battery unit can be recharged while the device is powering the system. A charge connector 77 of any desired construction is mounted to the face board 12 opposed to the top wall 7, as shown in FIG. 3. An opening 78 in wall 7 permits insertion of the connector jack, not shown, of a charging power supply. As shown in FIG. 14, a current limiting resistor 79 is connected in the circuit for protecting of the battery 48.

A program flow chart showing the operation of the control system to solve and operate the puzzle is shown in FIG. 14.

The system upon start-up, such as by closing of the motion sensitive switch 20, initiates a housekeeping procedure, as at 80. The program sets the input/output port defaults and clears the read/write memory. The flag defaults and interrupt defaults sequentially are set. Upon completion of the housekeeping sequences, the processor in the manufacturing procedure may provide a self test for illuminating the LEDs in a test pattern indicating that the system is in proper operation.

The controller moves to the main task handling providing monitoring of the state of the unit and the operation of the puzzle as well as a routine for updating all of the internal tasks, as shown at 81 in FIG. 13. Thus, the several timers are updated, the position identify switches read and the LEDs memory registers scanned to record the existing state of the LEDs 8 of the several faces 2–7. This updating continues throughout the operation of the puzzle in accordance with conventional processor technology. Upon initial start-up, the program executes a random generation of illumination of the lights units 8 and then proceeds through the sequence. When first entering the main task handling, the controller first monitors the power up mode to see if the device is in the power up mode, as previously discussed. If it is, the power up logic system is run as at 82 and upon completion of the power up logic, the program steps to monitor the state of the top face in plane 9 as at 83. If there is no ace change, the program steps directly to execute a time out routine 84.

If a face change exist, the program first determines the level of operation and if level one has been solved. The appropriate color change rule or algorithm is found in the proper table and proceeds to execute color change as at 85. This program as noted is executed by executing both parts of the algorithm and storing the results in the registers such that the next multiplexed driving of the new face creates the new display which to the player appears to occur instantaneously with the rotation. The program then determines whether the cube color has been solved, that is, is the cube in one solid color as at 86. If not, the program steps to the timing period routing 84. If the color is solved, a check is made that the color is an allowable color. If the color is not allowed, the program steps to the time out routing 84.

If a proper color solution has been made, a color light show is executed, as at 87. If the color in fact also resulted in a completion of that level of puzzle solving, the processor determines that the level has been solved. If so, it proceeds to execute a very special additional light show superimposed on the original color light show and steps to the time out routing. Similarly, if the level is not solved, the program moves directly to the time out routing.

The time out routine is inserted to monitor and allow the player to rotate the cube within a given period. If no action is taken within a given period, it functions to first attract the players attention and finally turn-off the power supply of the system as by removing the signal from the latching transistor 52 and opening the battery connection. This avoids placing of the puzzle in storage without turn-off. The time out routine 84 includes a first input monitoring and idle timer to determine whether a first time out period has been established, as at 88. If the cube is activated prior to the time out period, the program steps immediately to the main task monitoring the power up mode and proceeding through the face control previously discussed.

If a first time period has expired, the program acts to turn-off all lights thereby turning the cube dark. This should attract the player's attention if further play is intended. However, an additional time period is allowed within which to again move the cube, which is monitored as at 89. If the player moves the cube within this latter time period, the program again steps to the main task for color change and turns on all LEDs with no loss in status of the game level, solution found as LED colors. If the additional time out period terminates or is passed, the program steps to execute a special light show entitled "Entice" Light Show which again is intended to further correct the attention of the player, and the cube power supply is turned off. The player would then have to again move the cube sufficient to close the motion sensitive switch 20 in which instance the total system would recycle including the housekeeping procedures.

In summary, if there is no face change within a predetermined time, it is assumed that the puzzle is in fact not being actuated. At the end of the time out routine or period, the lock up transistor is deenergized and the puzzle system resets and the lamp units 8 turned off. The time out routine establish two timing periods, the first of which turns-off the light units 8 and the second of which opens the power circuit. During the opening of the power circuit, a special light show may be created to provide further attraction of the user to the puzzle. The latter then requires further movement of the puzzle cube to reset the motion sensitive switch to restart the cycle.

The program then monitors the state of that face and all other faces to see if the cube has been solved.

The processor continues to so operate until a time out routing is executed. Although shown in a preferred construction, various changes can be made in the system and the hardware. Thus, the puzzle can be made in other shapes.

An alternate position sensor may use a single reference contact unit such as shown in FIG. 14. In this embodiment, a switch cube 90 is provided with a pair of intersecting octagonal chambers 91–92 and each of the four spaced sides of the octagons include a set of contacts 93 thus providing a set of contacts for each face of the cube. A single contact ball is mounted within the contact cube and can move through the intersecting chambers into engagement with any single set of contacts corresponding to the contacts in the lowermost plane. Thus the ball will contact a single set of leads in all six positions of the cube. The ball is a conductive member and thus shorts the leads and effectively provides an output signal to the computer. In this instance, the six switches would be inputted to the processor to monitor the position of the cube and the face in the top plane.

The outer wall structure of the housing may of course be otherwise formed particularly if a separate conventional bulb-type LED is used. In such event, it may be desirable to form the outer housing with a plurality of separate snap together walls having openings and chamber members for properly directing of the light. The outer face of the formed wall with the light apertures can be covered with an appropriate transparent cover mask to present a finished appearance.

The number of different colors to be generated can be reduced to create a simpler puzzle or increased to produce even more complex puzzles. The color areas of a cube face may require other display combinations for a solution. These and like changes can be readily produced by using of appropriate output elements with proper logic programming based on the edge or area rotational algorithm assignments which can be provided by those skilled in the art.

The present puzzle with the rotational based programming permits a puzzle with controlled levels of solution and with varying outputs for attracting and maintaining the player interest.

Various modes of carrying out the invention are contemplated as being within the scope of the following claims particularly pointing out and distinctly claiming the subject matter which is regarded as the invention.

We claim:

1. A visual puzzle apparatus, comprising an enclosure having a plurality of display surfaces in different planes and connected to each other by common edge portions, said enclosure being movable to locate each of said surface in a reference plane, a plurality of display means on each of said surfaces, logic means for selectively activating each of said display means on one of said surfaces, said logic means for activating said display means being coupled to selectively activate the display means in the display surface located in said reference plane and for establishing a puzzle solution in said display surfaces by rotation of the enclosure, said logic means including a plurality of display rule means for changing each display means in a display surface, said rule means being assigned to the different edge portions whereby each edge rotation generates a display change in accordance with the assigned rule means, each display rule being logically related to the other display rule means such that each display change establishes a valid step to a puzzle solution and is responsive to subsequent rotation of the enclosure in establishing a puzzle solution, and sensing means for sensing edge rotation of a display surface into said reference plane and the particular edge portion of the enclosure on which the enclosure rotated for controlling the activation of said logic means.

2. The puzzle apparatus of claim 1 wherein said enclosure is a rectangular box-like enclosure having six planar sides defining six display surfaces each of which includes four rotational edges, said sensing means including at least three position sensitive switch means distributed relative to each other and relative to three cartisan axes to provide signals identifying each of said surfaces when located in said reference plane and the location of said rotational edges.

3. The puzzle apparatus of the claim 2 wherein said switch means includes three mercury switch units each having contacts located at one end of an elongated enclosure, a conductive liquid in each of said enclosures and operative to engage the contacts and effectively enclose the switch with the contacts at a vertical position beneath the balance of the enclosure, and a switch support within the enclosure with said switches secured thereto.

4. A puzzle apparatus of claim 1 wherein said display means are light means and wherein said logic means includes a microprocessor, said light means each providing any one of a plurality of at least three different colors, said change rule means includes a plurality of color change algorithms for sequentially changing of the light means in a sequence wherein all light means of a one color are changed to a second of said different colors and all colors of said second color are changed to a third color of said different colors, and including a wrap-a-round final change wherein said third color is changed to one of said colors whereby all of said surfaces can be converted to a common color in response to a plurality of different edge portion rotations of said enclosure about said common edge portions.

5. The puzzle apparatus of claim 4 wherein algorithms include a first table of assigned algorithms defining color rule change programs applied to at least a plurality of said edge portions, said first table defining a first level of play, a second table of assigned algorithms including a plurality of complex wrap around color rule changes and random color generation color rule changes, said second table defining a second level of play of greater difficulty than said first level to solve the puzzle.

6. The puzzle apparatus of claim 1 wherein said logic means includes a self-contained power supply means and a timing means adapted to establish a timing period, means responsive to the positioning a display surface into said reference plane to reset said timing means, first means responsive to said timing means to de-activate all of said display means after a first predetermined time period, and second means responsive to said timing means for a second timing period longer than said first timing period to open said power supply means and turn said logic control means off.

7. The puzzle apparatus of claim 6 including means responsive to said first timing period to establish a rapid activation of all of said display means prior to said second timing period.

8. The puzzle apparatus of claim 1 wherein said enclosure is formed of an outer dark colored display surface, each of said display means including a plurality of colored light means distributed over the display surface, said logic means changing the color of said light means in response to said rotation about said edge portions, show means for activating of said light means in at least one rapid sequential change of the light means to different colors to generate a light display show, and means responsive to placing all of said light means in said predetermined puzzle solution display to activate said show means.

9. The puzzle apparatus of claim 8 wherein said show means includes a plurality of different rapid color change sequences whereby different display light shows are generated, and means responsive to the sequential establishment of different puzzle solutions to selectively generate said different light shows.

10. The puzzle apparatus of claim 1 including a power circuit for said logic means and said display means, a motion sensitive switch operative to generate a momentary signal and connected in said power circuit, a control means including a latch switch means connected in parallel with said motion sensitive switch and operative to latch said power circuit to a power supply in response to momentary actuation of said motion sensitive switch.

11. The puzzle apparatus of claim 1 wherein said display means are multicolor light means and said logic control system includes a display driver means connected to said light means and a processor programmed to monitor the position of said enclosure and activate said drive means, said processor including storage means including a color map for each face storing the color of each light means in the face, means to monitor a change of the display surface located in said reference plane, said means being responsive to a face change to detect the new face, means responsive to said detection to select a color change algorithm for changing of the light means of one color to a different color and operable to perform the color change in the processor and storing said color change in the processor color map for said face and thereafter actuate the drive means.

12. The puzzle apparatus of claim 11 including means responsive to absence of a change in the display surface in said reference plane for a predetermined period to turn off said power supply to said processor system.

13. A puzzle apparatus, comprising a polyhedral enclosure having a plurality of flat faces joined by line boundary edges, said enclosure adapted to be hand manipulated to rotate each of the faces of the enclosure in a predetermining a reference plane, a plurality of similar light means located on each of said faces, each light means generates any one of at least three corresponding colors, a programmed logic means including a self-contained power supply mounted within said enclosure, means connecting said logic means to said light means and operable to selectively energize said light means with any one of said three colors, means coupled to said enclosure and operable to establish electrical signals identifying the orientation of said enclosure with respect to said reference plane and identifying each face of said enclosure with respect to said reference plane, said logic means including a color change program including a plurality of different algorithms, each of said algorithms defining a series of color changes for each of said light means, said program including a table assigning said algorithms to the selected boundary edges of said faces, each of said boundaries including at least two assigned algorithms including a first algorithm assigned to the edge for execution in response to a first rotation about said edge to present a first of the adjoining faces in said reference plane and a second algorithm assigned to said edge in response to opposite rotation about said boundary edge for placing of the second of the adjoining face in said reference, plane, each of said algorithms providing for sequentially changing the color of the light means to a final one of said colors, whereby the edge rotation of said cube provides for sequential change of the light means in each of said faces and permitting the changing of the enclosure to present a single color display on all faces in response to selected edge rotations of said enclosure defining a puzzle solution.

14. A puzzle apparatus of claim 13 wherein said plurality of different algorithms change all light means of a one color to a second of said three colors and all colors of said second color are changed to the third color of said three colors, and including a wrap around change wherein said third color is changed on one of said three colors whereby all of said faces can be converted to a common color in response to a plurality of different edge rotations of said enclosure about said boundary edges.

15. The puzzle apparatus of claim 14 wherein said algorithms include a first table of assigned algorithms including inverse color rule changes applied to at least a plurality of said boundary edges, said first table defining a first level of play, a second table of assigned algorithms including a plurality of complex wrap around color rule changes and random color generation color rule changes, said second table defining a second level of play of greater difficulty than said first to solve the puzzle.

16. The puzzle apparatus of claim 13 wherein said logic means includes a self-contained supply means and a timing means adapted to establish a timing period, means responsive to the positioning a display face into said reference plane to reset said timing means, first means responsive to said timing means to de-activate all of said light means and darken said enclosure after a first predetermined time period, and means responsive to a second timing period longer than said first timing period to open said power supply means and turn said logic means off.

17. The puzzle apparatus of claim 16 including means responsive to said first timing period to establish a rapid activation of all of said light means prior to said second timing period.

* * * * *